US005671790A

United States Patent [19]

Andersen et al.

[11] Patent Number: 5,671,790

[45] Date of Patent: Sep. 30, 1997

[54] SCREENING DEVICE FOR A WALL OPENING

[75] Inventors: Hans Gram Andersen, Sønder Felding; Per Stagsted Jacobsen, Horsens, both of Denmark

[73] Assignee: V. Kann Rasmussen Industri A/S, Søborg, Denmark

[21] Appl. No.: 590,946

[22] Filed: Jan. 24, 1996

[51] Int. Cl.[6] ..... A47H 1/00

[52] U.S. Cl. ..... 160/24; 160/31

[58] Field of Search ..... 160/31, 24, 272, 160/273.1, 279, 267.1, 277, 274, 270, 271, 23.1

[56] References Cited

U.S. PATENT DOCUMENTS

| | | | |
|---|---|---|---|
| 1,333,516 | 3/1920 | Thomsen | 160/274 |
| 1,612,261 | 12/1926 | Burns | 160/31 |
| 1,745,208 | 1/1930 | Dixson | 160/31 |
| 2,025,630 | 12/1935 | Yartyan | 160/31 |
| 2,094,790 | 10/1937 | Gottert | 160/31 |
| 2,270,978 | 1/1942 | Swormstedt | 160/31 X |
| 2,383,015 | 8/1945 | Pratt | 160/267.1 X |
| 4,317,480 | 3/1982 | Phelps | 160/267.1 X |
| 4,658,879 | 4/1987 | Van Klompenburg | 160/31 X |
| 5,535,806 | 7/1996 | Kold et al. | 160/279 X |

FOREIGN PATENT DOCUMENTS

| | | | |
|---|---|---|---|
| 22609 | 4/1936 | Australia | 160/267.1 |
| 0489450 | 6/1992 | European Pat. Off. . | |
| 1009671 | 3/1952 | France | 160/279 |

*Primary Examiner*—Blair Johnson
*Attorney, Agent, or Firm*—Lane, Aitken & McCann

[57] ABSTRACT

A collapsible screening device such as an insect screen for an opening in a wall, particularly for a window or door, comprises a frame structure composed of an elongate base member accommodating a screening in a first retracted position, two side members pivotally connected with opposite ends of the base member, so as to be collapsible from an erected position at substantially right angles from the base member into a collapsed position parallel and close to the base member, and a separate bar member of a length substantially equal to the length of said base member. A free end of each side member and opposite ends of the separate bar member are formed with releasably interlocking assembling means to provide a stable connection in an assembled condition of the frame structure. The screening member and each side members are provided with cooperating guide means for guiding said screening member during movement thereof from the retracted position towards a second extracted position in which it screens the wall opening.

15 Claims, 4 Drawing Sheets

SCREENING DEVICE FOR A WALL OPENING

This invention relates to screening devices for wall openings, in particular windows or doors.

Screening devices to which the invention pertains include, in particular, roller shades or insect screens in which a web of flexible screening material is accommodated, in a non-operative condition, in one member of a substantially rectangular frame structure for the window or door, from where it may be extracted into an operative condition in which it completely covers the area of the window or door.

Typically the web of screening material may, in the non-operative condition, be rolled-up on a take-up roller accommodated in a member of the frame structure such as known e.g. from European Patent No 0 489 450. Alternatively, the web of screening material may have a pleated configuration.

In some cases, however, in particular with insect screens, the need of using the screening device is limited to certain periods, such as the summer season, whereas in other periods the user may prefer not to have the inner side of the door or window obstructed by the arrangement of the screening device.

With skylight windows mounted in an inclined roof surface it is normally necessary to use lateral guide and holding members extending parallel to the direction of movement for the extraction and retraction of the web of screening material such as disclosed in the above-mentioned European patent.

On this background it is the object of the invention to provide a screening device, suitable in particular for skylight windows, which may easily be mounted on an existing window frame structure and disconnected therefrom, when its use is not needed and which in the disconnected condition is easy to handle with respect to transportation and storage.

According to the invention a screening device for an opening of a substantially rectangular configuration in a wall is provided, which comprises a frame structure composed of an elongate base member accommodating a screening member in a first position in which it assumes a rolled-up, folded-up or collapsed condition, two side members each having one end pivotally connected with one of two opposite ends of said base member, and a bar member of a length substantially equal to the length of said base member forming a fourth side of said frame structure, the connections between said base member, side members and bar member forming at least one pair of pivotal links, whereby to make the frame structure collapsible from an erected condition in which the side members project at substantially right angles from the base member into a collapsed condition in which they are folded into overlying relationship with the base member, said screening member and each of said side members being provided with cooperating guide means for guiding said screening device in said erected condition during movement thereof from said first position towards a second extracted position in which it screens said opening.

Screening devices to which the invention pertains may typically be an insect screen which in the first position in which it is entirely accommodated within the base member is rolled-up on a take-up roller in the form of a web of a flexible screening material such as a relatively fine mesh-grid of a metallic or plastic material, e.g. fiber glass.

However, the collapsible screening device of the invention may also be advantageous in connection with other forms of screening devices, such as roller shades or pleated curtains or venetian blinds, which in the first position may be accommodated within the base member in either a folded-up or collapsed condition.

In a preferred embodiment said bar member may be a separate member and a free end of each of said side members remote from said one end and opposite ends of said separate bar member are formed with releasably interlocking assembling means to provide a stable connection between said bar member and said side members in said erected condition of the frame structure.

However, the bar member may also be permanently connected with the side members if the connections between the side members and the base and bar members are formed as pivotal links and a pivotal link is further provided in the middle of each side member, stabilizing means being provided to stabilize the frame structure in the erected condition.

In the following the invention will be further explained with reference to the accompanying drawings in which FIG. 1 is a perspective view of a conventional sky-light window mounted in an inclined roof surface and an embodiment of a screening device according to the invention is arranged for mounting on the sky-light window;

Figure 1:
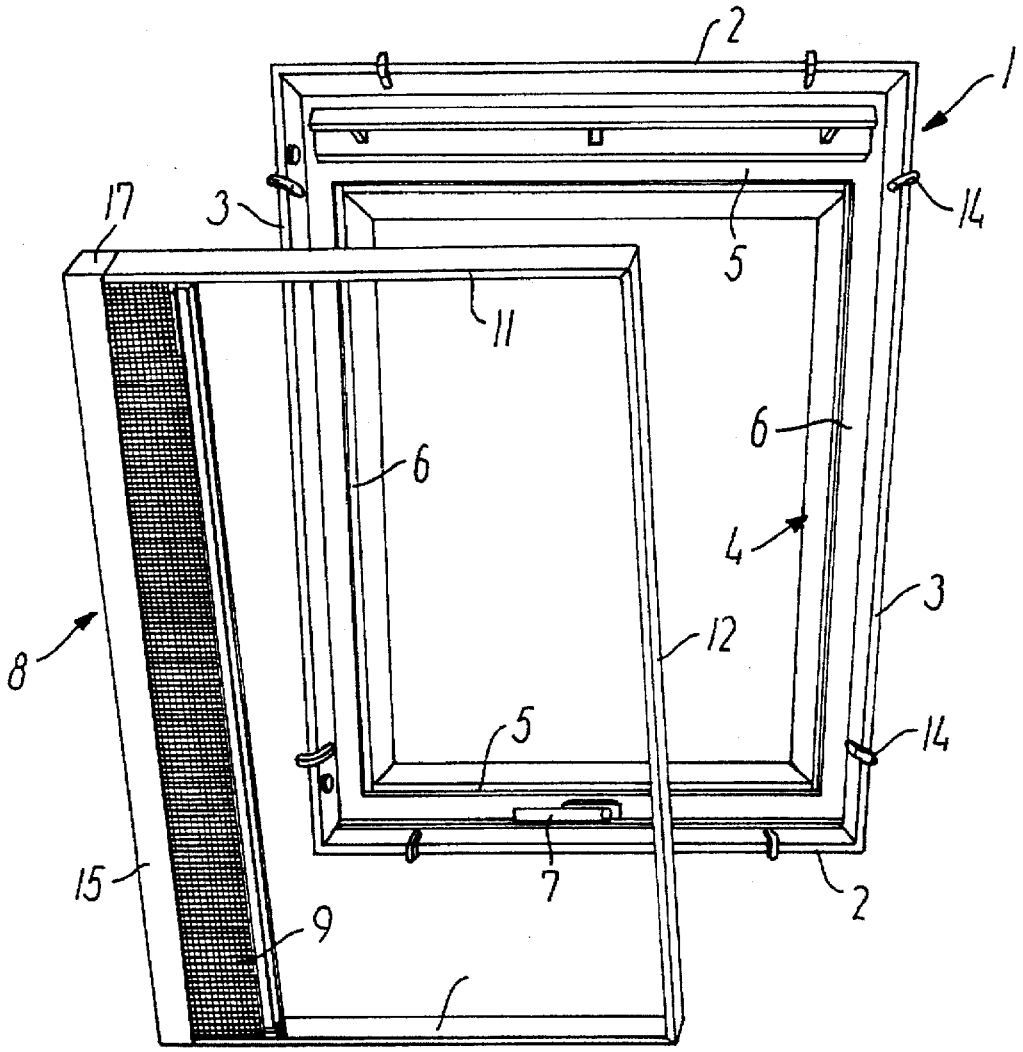

The sky-light window shown in FIG. 1 may be of a conventional design arranged for mounting in an inclined roof surface and comprises a rectangular main frame structure 1 assembled from horizontal and vertical main frame members 2 and 3 and being firmly secured in a substantially rectangular opening in the roof surface, as well as an openable frame structure 4 likewise assembled from horizontal and vertical frame members 5 and 6, the frame structure having an operating handle 7 with an associated locking mechanism arranged in a lower horizontal frame member.

In the embodiment shown, the collapsible screening device according to the invention comprises a frame structure which is composed of an elongate base member 8 accommodating a screening member 9 in the form of an insect screen having a web of a flexible, relatively fine-mesh grid carried by a take-up roller arranged in the base member 8, so that in a first position the screening member 9 may be completely rolled-up and entirely accommodated within the base member 8, and further comprising two side members 10 and 11 which in one end are pivotally connected with opposite ends of the base member 8, whereas the free end of each of the side members 10 and 11 remote from the end connected with the base member 8 is connectable with a separate bar member 12 arranged to form the fourth side of the frame structure.

Figure 2:
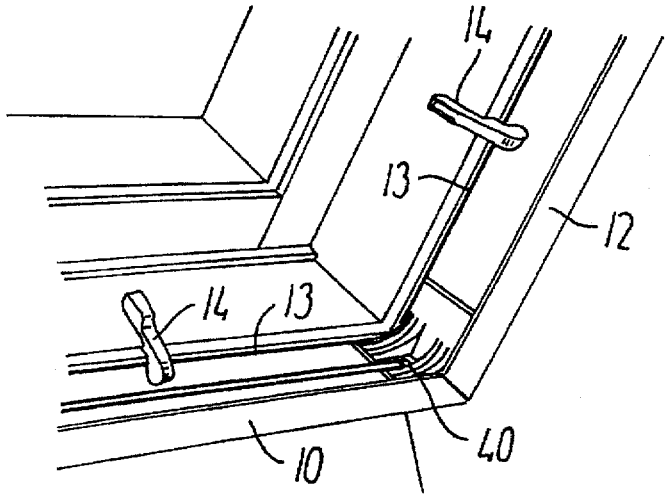
FIG. 2 is a perspective view showing in further detail the fastening of the screening device to the main frame construction of the sky-light window in FIG. 1.

As more clearly apparent from FIG. 2, the base member 8, side members 10 and 11 and bar member 12 of the frame structure are provided along one side 13 with a raised or bent flange portion providing engaging means which are releasably engageable by holding members 14 secured to the horizontal and vertical members of the main frame structure 1. The holding members 14 may as shown typically be hook-like snap-locking members of a conventional type.

In the embodiment shown, the frame structure of the collapsible screening device is designed to have the base member 8 connected with one of the vertical members of the main frame structure 1, so that the side members 10 and 11 forms the shorter sides of the frame structure. Depending on the height and width dimensions of the window a frame structure of the screening device may, however, also be arranged to have the base member connected with the upper or lower horizontal member of a window main frame structure.

Figure 3:
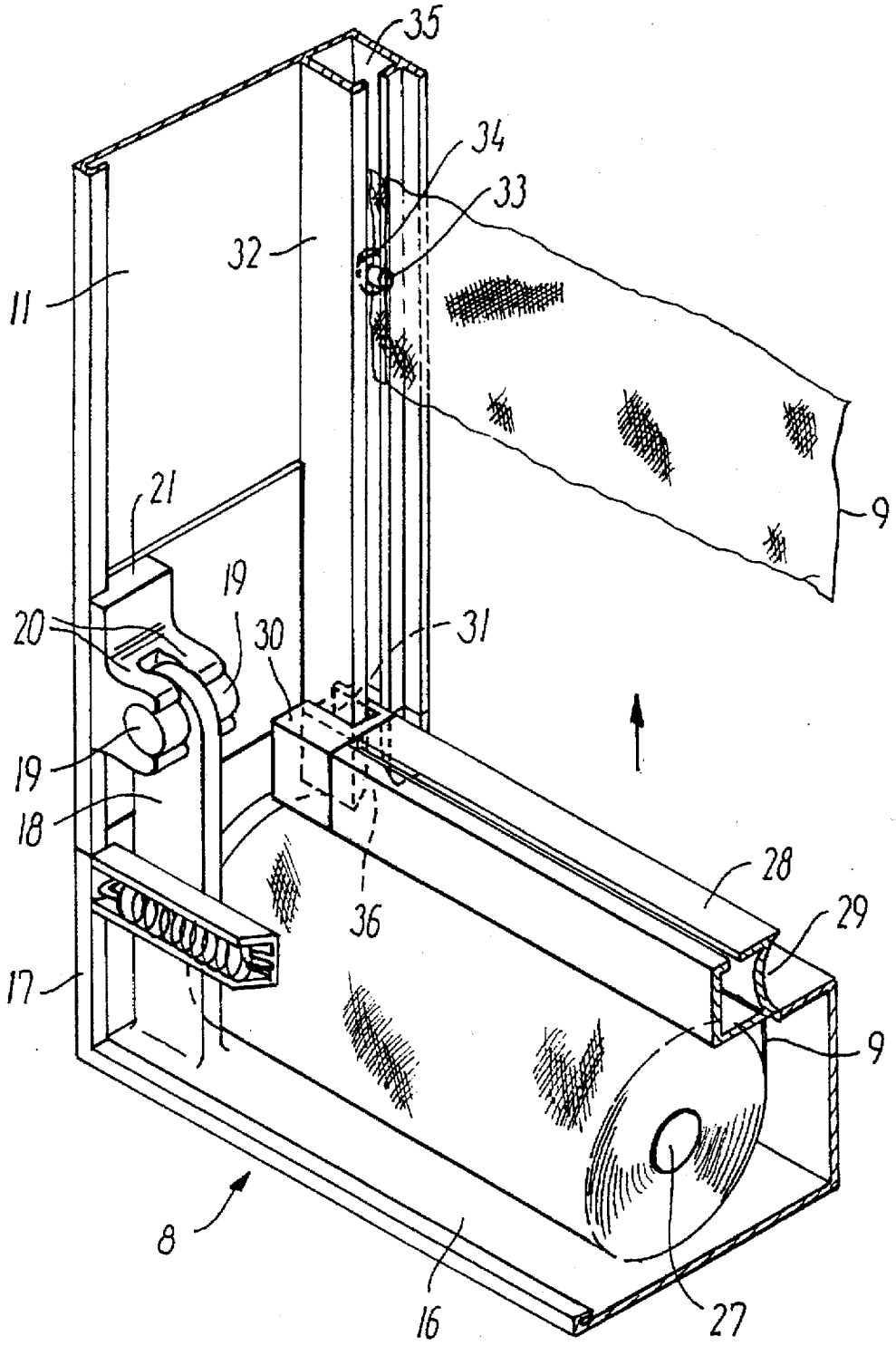
FIG. 3 is a perspective view of parts of the screening device embodiment as viewed from the opposite side with respect to FIG. 1.

As apparent from FIGS. 1 and 3 the base member provides an elongate box-like cabinet for accommodation of the rolled-up screening member 9, limited by a front wall 15, a side wall 16 and end walls 17, whereas the rear side of the base member cabinet is open. At each of end walls 17 an arm 18 is secured inside the base member 8 to project outwards from the base member parallel to the end wall 17. In its free end arm 18 is provided with pin-like lateral projections 19 which are pivotally journalled in corresponding bracket elements 20 of a bearing console 21 secured to the inner side of each of side members 10 and 11 to establish the pivotal connection between each side member and the base member 8. By means of this pivotal connection each of side members 10 and 11 may as shown in FIG. 4 be collapsed from the erected position shown in solid lines into a collapsed position shown in dotted lines in which the side members 10 and 11 extend substantially parallel and close to the base member 8 in overlying relationship therewith.

Whereas in the embodiment shown the length of each of side members 10 and 11 is a little less than half the length of the base member 8, so that in the collapsed position the side members 10 and 11 will not overlap each other, the frame structure may be designed with a greater length of the side members and in order to allow the side members to overlye one another in the collapsed position the projecting arms 18 at either end of the base member 8 may be of different length.

As further shown in FIG. 3 the end portions of arms 18 projecting beyond the end walls 17 of cabinet 8 will form a stop for the pivotal movement of the side members 10 and 11 in the erected position in which they extend at substantially right angles to the base member 8.

Figure 4:
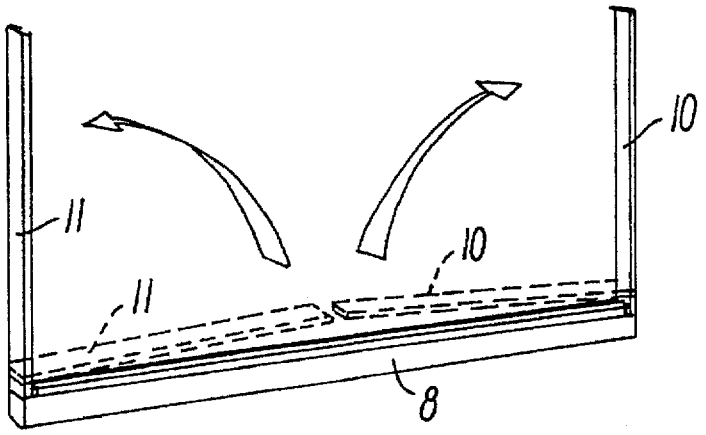
FIG. 4 is a perspective view illustrating the collapsability of the base and side members of the frame structure of the screening device embodiment in FIG. 1.

In the collapsed condition of the base member 8 and the side members 10 and 11 with the latter assuming the position shown in dotted lines in FIG. 4, these members of the frame structure may be packed together with the separate bar member 12 to occupy very little space for transportation and storage in periods, when the screening device such as an insect screen is not needed.

Figure 5:
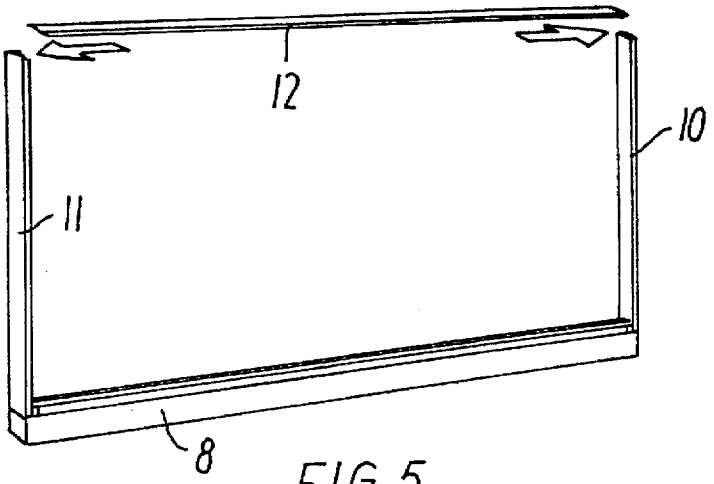
FIG. 5 is a perspective view illustrating the assembling of the collapsible structure of FIG. 4 with a separate bar member to form a complete frame structure.
Figure 6:
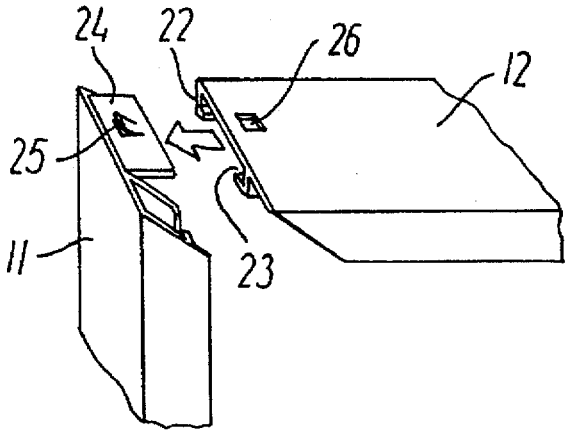
FIG. 6 is a perspective view illustrating in detail an embodiment of interlocking assembling means for connecting the bar and side members of the frame structure in FIG. 4.

As further illustrated in FIG. 5, the frame structure of the screening device is completed in erected position of side members 10 and 11 by connecting the free ends of the side members remote from the base member 8 with opposite ends of the separate bar member 12.

To provide a releasably interlocking assembling of the separate bar member 12 with the side members 10 and 11 the separate bar member 12 is formed in the embodiment shown with flange portions 22 bent-in to project from the internal side of the bar member 12 facing the base member 8 in the completed frame structure to form a track 23 extending throughout the length of the bar member 8, and each of side members 10 and 11 is formed in its free end with a projecting tongue 24 engageable with one end of track 23. To establish inter-locking of each side member 10, 11 with bar member 12 snap-lock means are provided at the tongue 24 and at each end of the track 23, e.g. in the form of a bent-up hook part 25 at the tongue 24 engaging a mating hole 26 at the end of track 23.

Returning to the perspective view in FIG. 3 it is seen that in the embodiment shown the flexible web of the screening member 9 is rolled-up on a take-up roller 27 accommodated in the box-like base member cabinet 8 and the free end of the web is connected with an end rail member 28 which on the front side is formed with a track 29 of a curved cross sectional profile to provide gripping means facilitating extraction of the web 9 from the rolled-up position towards a position in which the end rail member 28 contacts the bar member 12 of the frame structure to screen the opening of the sky-light window.

In each end of the end rail member 28 an end piece 30 is arranged which is formed with a transverse slot 31 parallel to the direction of the web 9. To engage with the slot 31 to provide cooperating guide means for the movement of screening web 9 a projecting rail member 32 is formed on the inner side of the each of side members 10 and 11.

Due to the flexibility of the web 9 it is desirable also to provide for secure guiding of the edges of the web material itself during the extraction movement. In the embodiment shown, this is obtained by providing the web 9 along its opposite side edges parallel to the direction of the extraction movement with guide means which as shown may comprise flat guide pins 33 squeezed or otherwise affixed to the web material and having enlarged heads 34 projecting from the side edges of the web 9 to engage with mating guide means formed at the inner side of each of side members 10 and 11 in the form of a track 35 with a narrow opening 36 for the web material 9 to receive the enlarged heads 34 within track 35.

The projecting rail member 32 on the inner side of each of side members 10 and 11 is positioned and formed so that by the pivotal movement of the side member from the collapsed position into the erected position shown in FIG. 3 it will automatically engage with the transverse slots 31 formed in the end pieces 30 of rail member 28 and at the end of the track 35 for the enlarged heads 34 of guide pins 33 suitable guide means may be provided, e.g. by means of an increased inlet width of the narrow opening 36 of track 35, to secure entrance of the enlarged heads 34 into the track 35 to provide guiding to the screening web 9.

Figure 7:
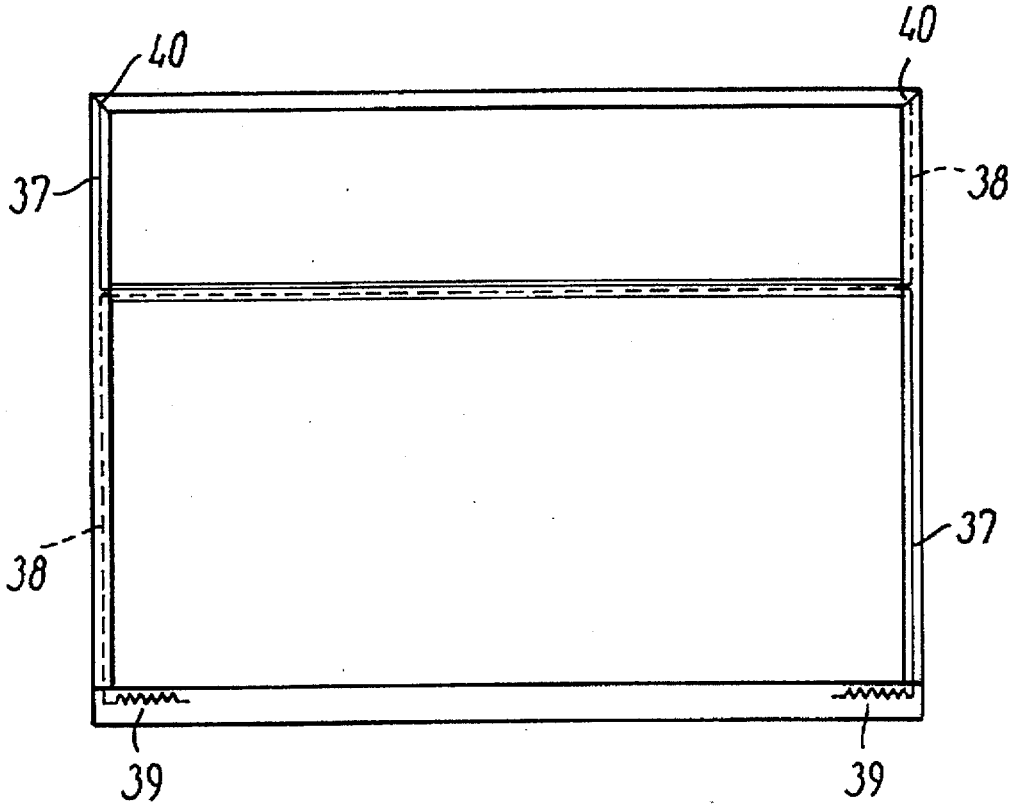
FIG. 7 is a schematic representation of a guide cord control arrangement for movement of the screening member of the screening device embodiment in the previous figures.

As schematically illustrated in FIG. 7 the screening device according to the invention may in the embodiment shown be provided with a guide cord arrangement of a type known per se as control means to maintain the end rail member 28 in a substantially parallel relationship with the base member 8 of the frame structure in any position of the end rail member during the extraction movement. This guide cord arrangement may comprise two guide cords 37 and 38 each of which is anchored at one end of the base member 8 with interposed spring means, e.g. in the form of a helical spring 39 to provide tensioning to the cord, which extends through the adjoining part of the side member 10 or 11 extending between the base member 8 and the end rail member 28, further throughout the length of the end rail member 28 to the opposite end thereof and from said opposite end of the end rail member 28 to have the opposite end of the cord secured by fastening means 40 such as a hook provided at the end of the other side member 11 or 10 connected with the bar member 12 as shown in FIG. 2.

To more clearly distinguish guide cords 37 and 38 from each other the guide cord 37 is shown in solid lines whereas the guide cord 38 is shown in dotted lines.

Whereas in the foregoing a specific embodiment of a collapsible screening device according to the invention is described the structural details of the screening device may be varied within wide limits provided by the scope of the claims.

We claim:

1. A screening device for covering an opening of substantially rectangular configuration in a wall of a building, comprising a frame structure composed of an elongate base member accommodating a screening member in a first position in which it assumes a stored condition, two side members each having one end pivotally connected with one of two opposite ends of said base member, and a bar member of a length substantially equal to the length of said base member forming a fourth side of said frame structure, the frame structure having an erected condition in which the side members project at substantially right angles from the base members, said bar member in said erected condition being spaced from a free edge of said screening member when said screening memer is in said stored condition, the connections between said base member, side members and bar member forming at least one pair of pivotal links, whereby to make the frame structure collapsible from said erected condition into a collapsed condition in which the side members are folded into overlying relationship with the base member, said screening member and each of said side members being provided with cooperating guide means for guiding said screening device in said erected condition during movement thereof from said first position towards a second extracted position in which it screens said opening.

2. A screening device as claimed in claim 1, wherein said bar member is a separate member and a free end of each of said side members remote from said one end and opposite ends of said separate bar member are formed with releasably interlocking assembling means to provide a stable connection between said bar member and said side members in said erected condition of the frame structure.

3. A screening device as claimed in claim 2, wherein said screening member comprises a web of flexible screening material, and an end rail member is connected with a free end of said web, said end rail member having end pieces formed to provide first guide means engaging second guide means provided on said side members.

4. A screening device as claimed in claim 3, wherein said first guide means comprises a slot formed in each end piece of said end rail member and said second guide means comprising a projecting rail member engaging said slot.

5. A screening device as claimed in claim 4, wherein said web of screening material is provided along opposite side edges parallel to the direction of said movement with third guide means and each of said side members is provided with fourth guide means to engage with said third guide means during said movement.

6. A screening device as claimed in claim 5, wherein said third guide means comprise a number of flat guide pins with enlarged heads affixed to each of said opposite side edges to have said enlarged heads project from said side edges and said fourth guide means comprises a track formed in each of said side members, said tracks having a narrowed opening for said web of screening material to receive said enlarged heads within said tracks.

7. A screening device as claimed in claim 3, wherein said end rail member is formed with gripping means to facilitate extraction of said web of screening material by manual operation.

8. A screening device as claimed in claim 3, wherein said frame structure is provided with control means to maintain said end rail member in a substantially parallel relationship with said base member in any position of the end rail member.

9. A screening device as claimed in claim 8, wherein said control means comprised a guide cord arrangement extending through each of said side members and said end rail member.

10. A screening device as claimed in claim 9, wherein said guide cord arrangement comprises two guide cords connected in one end with one end of said base member and extending therefrom through the adjoining part of the side member extending between said one end and one end of the end rail member, further throughout the length of the end rail member to its opposite end and from said opposite end of the end rail member to have the opposite end of the cord secured at the end of the other side member connected with said bar member.

11. A screening device as claimed in claim 10, wherein said one end of each cord is connected with said base member through spring means providing tensioning bias to said cord.

12. A screening device as claimed in claim 2, wherein at said opposite ends of the base member stop means are provided to limit outward pivotal movement of each side member from its collapsed position to said erected position.

13. A screening device as claimed in claim 2, wherein said separate bar member is formed with bent-in flange portions to provide on the side of the bar member facing the base member in said erected position a track extending throughout the length of the bar member, said opposite end of each side member being formed with a projecting tongue engageable with an end of said track.

14. A screening device as claimed in claim 13, wherein said assembling means comprise interlocking snap-lock means provided at said tongue of each side member and each end of said track.

15. A screening device as claimed in claim 1, further comprising a number of holding members for fastening to parts of said wall surrounding said opening for releasably holding said frame structure in its assembled condition, each of said base member, side members and separate bar member being provided along one side edge with engaging means releasably engageable by said holding members.

* * * * *

UNITED STATES PATENT AND TRADEMARK OFFICE

CERTIFICATE OF CORRECTION

PATENT NO. : 5,671,790

DATED : September 30, 1997

INVENTOR(S) : Hans Gram Andersen et al.

It is certified that error appears in the above-indentified patent and that said Letters Patent is hereby corrected as shown below:

Claim 1, column 5, line 25, "memer" should read "member".

Signed and Sealed this

Tenth Day of February, 1998

*Attest:*

*Attesting Officer*

BRUCE LEHMAN

*Commissioner of Patents and Trademarks*